United States Patent [19]

Sato

[11] Patent Number: 4,484,506

[45] Date of Patent: Nov. 27, 1984

[54] TUNING CONTROL APPARATUS

[75] Inventor: Kunio Sato, Tokyo, Japan

[73] Assignee: Casio Computer Co., Ltd., Tokyo, Japan

[21] Appl. No.: 461,161

[22] Filed: Jan. 26, 1983

[30] Foreign Application Priority Data

Feb. 1, 1982 [JP] Japan ..... 57-13370

[51] Int. Cl.[3] ..... G10G 7/02; G10H 1/44

[52] U.S. Cl. ..... 84/1.01; 84/454; 84/477 R; 84/478

[58] Field of Search ..... 84/1.01, 1.28, 454, 84/477 R, 478, DIG. 18

[56] References Cited

U.S. PATENT DOCUMENTS 4,281,577 8/1981 Middleton ..... 84/454

4,327,623 5/1982 Mochida et al. ..... 84/454

4,351,212 9/1982 Okamoto et al. ..... 84/454 X

FOREIGN PATENT DOCUMENTS 3013681 10/1980 Fed. Rep. of Germany .

*Primary Examiner*—S. J. Witkowski

*Attorney, Agent, or Firm*—Frishauf, Holtz, Goodman and Woodward

[57] ABSTRACT

Basic frequency data is preliminarily stored in a ROM. Tuning data obtained from a tuning counter according to manual operation of a rotary switch, and basic frequency data out from the ROM are processed in a CPU to form modified frequency data, which is stored in a RAM. The modified frequency data stored in the RAM is selectively read out according to the operation of the keyboard, so that a tuned note sound is produced from a loudspeaker.

12 Claims, 16 Drawing Figures

FIG. 5

| ROTATION ANGLE | CONTACT F1 OUTPUT | CONTACT F2 OUTPUT | STATE |
|---|---|---|---|
| | | | 0 0 |
| | | | 1 0 |
| 90 | 1 | 1 | 1 1 |
| 91 | 0 | 1 | 0 1 |
| 92 | 0 | 0 | 0 0 |
| 93 | 1 | 0 | 1 0 |
| 94 | 1 | 1 | 1 1 |
| | | | 0 1 |
| | | | 0 0 |
| | | | 1 0 |
| | | | 1 1 |
| | | | 0 1 |
| | | | 0 0 |
| | | | 1 0 |
| | | | 1 1 |
| | | | 0 1 |
| | | | |
| | | | |

FIG. 6

| | |
|---|---|
| C | 157 (=343) |
| C# | 16C (=364) |
| D | 182 (=386) |
| D# | 199 (=409) |
| E | 1B1 (=433) |
| F | 1CB (=459) |
| F# | 1E6 (=486) |
| G | 203 (=515) |
| G# | 222 (=546) |
| A | 242 (=578) |
| A# | 265 (=613) |
| B | 289 (=649) |

FIG. 12
| | |
|---|---|
| C | 1 A C (=428) |
| C# | 1 C 7 (=455) |
| D | 1 E 2 (=482) |
| D# | 1 F F (=511) |
| E | 2 1 D (=541) |
| F | 2 3 D (=573) |
| F# | 2 5 F (=607) |
| G | 2 8 3 (=643) |
| G# | 2 A A (=682) |
| A | 2 D 2 (=722) |
| A# | 2 F E (=766) |
| B | 3 2 B (=811) |
FIG. 13
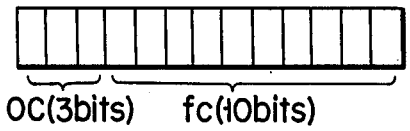
FIG. 14
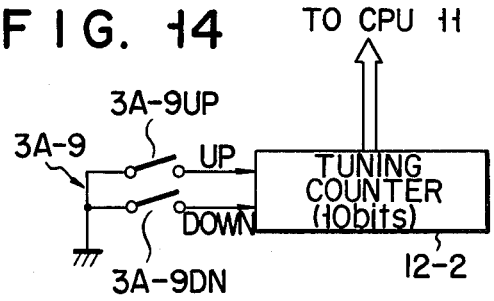

TUNING CONTROL APPARATUS

BACKGROUND OF THE INVENTION

This invention relates to a tuning control apparatus for an electronic musical instrument.

The pitch of musical tones is usually different with different musical instruments. For example, the pitch of the tone of note A4, for instance, is usually set at slightly different values with natural musical instruments such as the piano, the violin, the flute, etc. and electronic musical instruments. The slight departure from the proper frequency of the note A4, e.g., whether it is 440 Hz or 442 Hz, does not substantially matter so long as an instrument is played solely. However, when a natural musical instrument, e.g., the piano, and an electronic musical instrument are played in concert, it is necessary to tune the instruments to set A4, for instance, to 440 Hz. Since the piano cannot be tuned at the time of performance, the electronic musical instrument is tuned at this time.

The prior art electronic musical instruments are usually provided with a volume switch or slide switch for tuning the instrument. In this case, the oscillation frequency of the main oscillator or VCO (voltage controlled oscillator) is varied by operating the volume switch or slide switch. As the oscillator is one using discrete parts such as LC (coil and capacitor) or RC (resistor and capacitor), it is necessary to provide a comparatively wide frequency range. The characteristics of such discrete parts are subject to changes in long use or with temperature changes, which is undesired from the standpoint of stable and accurate tuning.

With some prior art electronic musical instruments, the above tuning is displayed on the casing of the insturment. In one of such electronic musical instruments, tuning over a 50 percent range is done either upwards or downwards by turning a screw on the casing with a screw driver, and in another case a select switch is used for setting the frequency corresponding to the note A4, for instance, to either 440, 442 or 444 Hz. In the former case, one cannot know the precise tuned value, and also reproducibility is insufficient. In the latter case, limitations are imposed on the range or number of frequencies that can be set.

SUMMARY OF THE INVENTION

An object of the invention is to provide a tuning control apparatus, which permits accurate tuning irrespective of the kind of oscillator used as a tone generator, and also permits setting a broad tuning frequency range.

With the tuning control apparatus according to the invention, reference frequency data is stored in a ROM (read only memory), and tuning data obtained according to an external operation of a rotary switch or like tuning means is processed with reference frequency data read out from the ROM to obtain resultant frequency data. The resultant frequency data thus obtained is stored in a read-write memory so that tones are obtained according to the data stored in the read/write memory. Accurate tuning thus can be obtained at all times irrespective of the kind of oscillator used as the main oscillator.

In one preferred form of the invention, there is provided a tuning control apparatus, in which the modified frequency data obtained through the processing or the reference frequency data from the ROM, is digitally displayed.

In another preferred form of the invention, there is provided a tuning control apparatus, in which the tuning data is obtained by operating an up-down switch which has high operation control characteristics, or a rotary switch which is capable of ready fine adjustment.

In a further preferred mode of the invention, there is provided a tuning control apparatus, in which a tone corresponding to the modified frequency is automatically sounded in a tuning mode so that the player can confirm the tuned note.

BRIEF DESCRIPTION OF THE DRAWINGS

FIG. 5 is a view for explaining the operation of the circuit of FIG. 4;

FIG. 6 is a view showing data stored in a ROM;

FIG. 12 is a view showing data stored in a RAM;

FIG. 13 is a view showing the data format of frequency data provided from a CPU;

FIG. 14 is a schematic showing the circuit construction of a different embodiment of the invention.

DETAILED DESCRIPTION OF THE PREFERRED EMBODIMENTS

Figure 1:
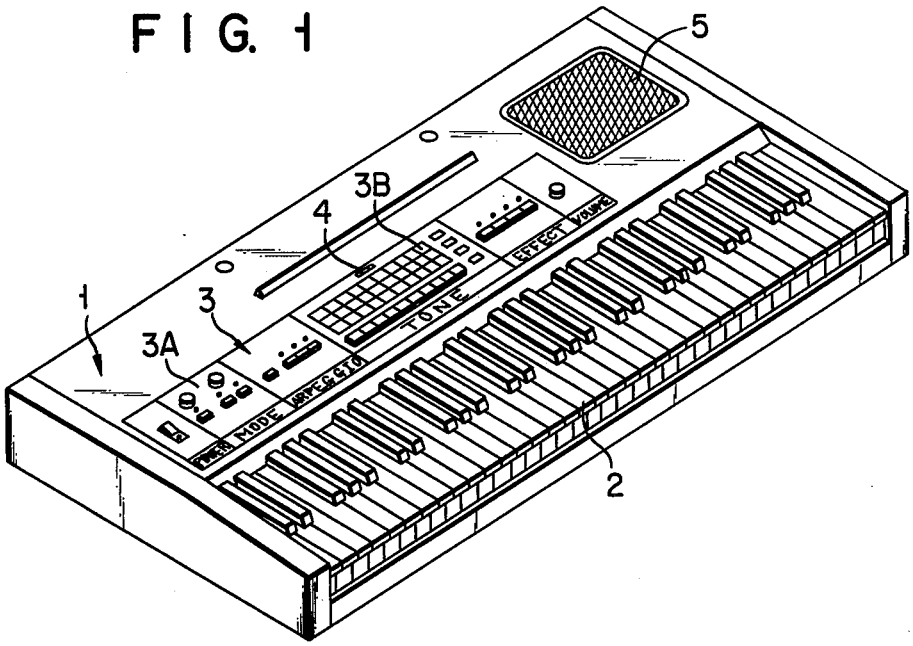
FIG. 1 is a perspective view showing an electronic musical instrument embodying the invention.

FIG. 1 is a perspective view showing an electronic musical instrument. The electronic musical instrument incorporates an embodiment of the tuning control apparatus according to the invention for tuning the tones to be generated.

Figure 2:
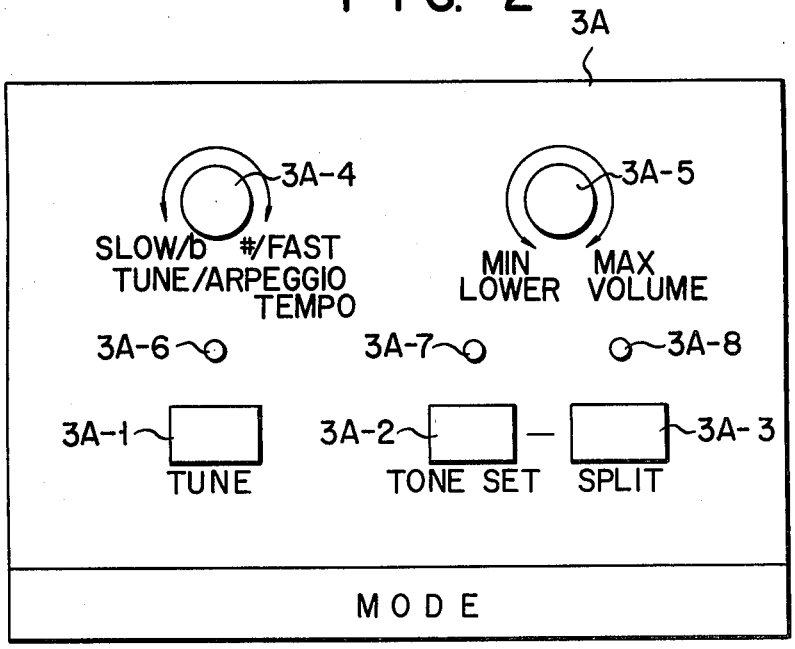
FIG. 2 is a plan view showing a mode switch section shown in FIG. 1.
Figure 3:
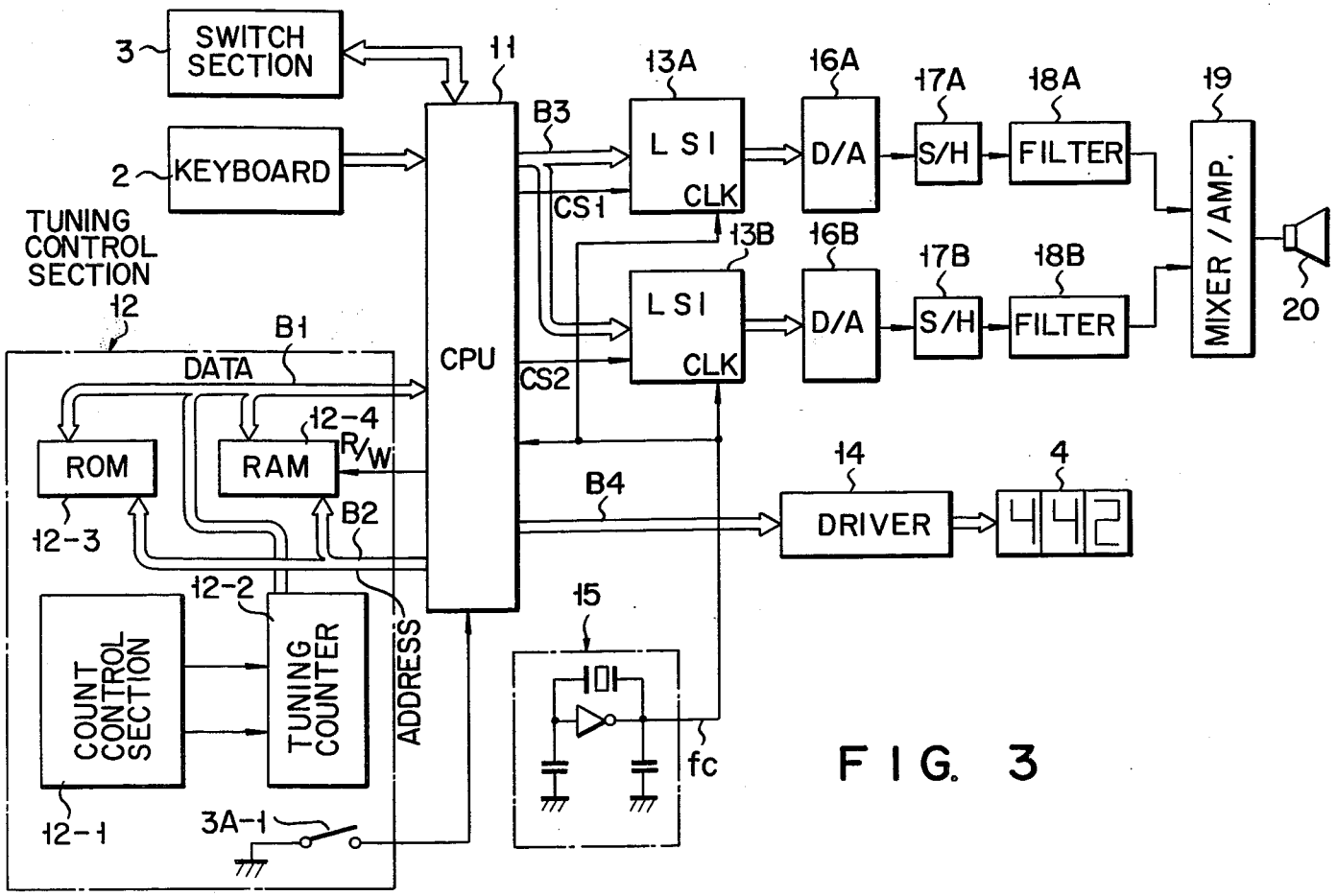
FIG. 3 is a block diagram showing the circuitry of the electronic musical instrument of FIG. 1.
Figure 4:
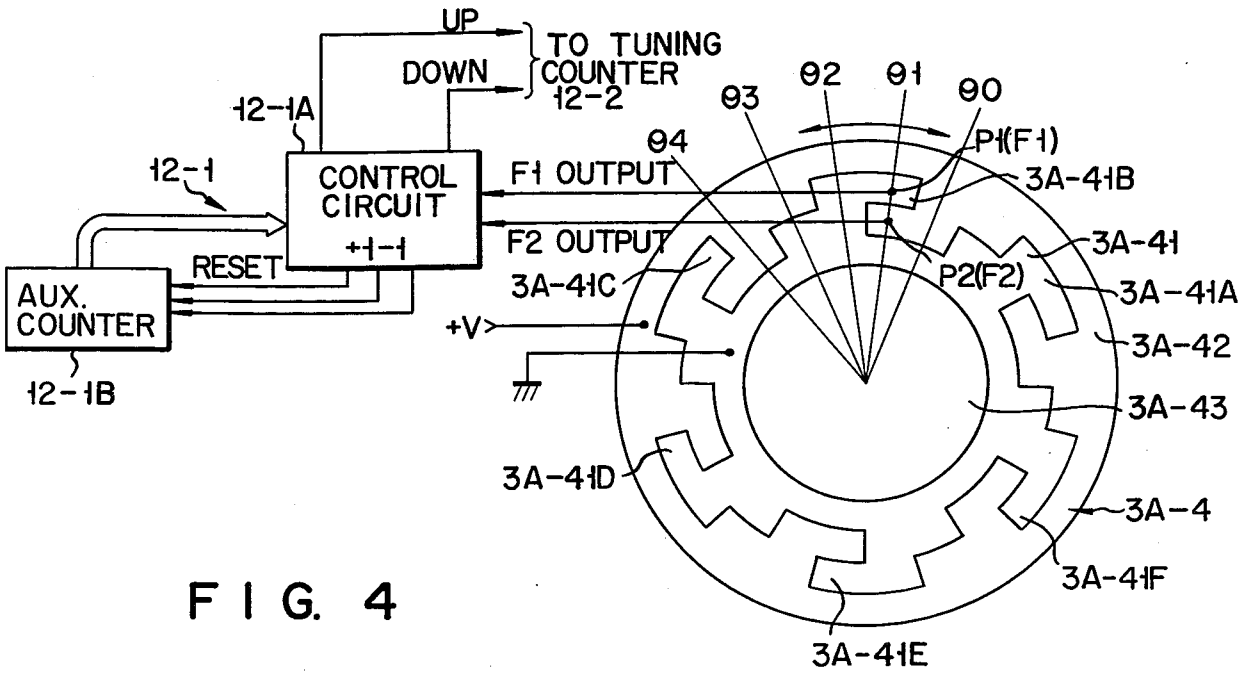
FIG. 4 is a schematic representation of a count control section shown in FIG. 3.

As shown in FIG. 1, the electronic musical instrument has a casing 1, which has a keyboard 2 having 61 performance keys for 5 octaves. On the casing 1 are also provided a switch section 3 having various switches, a display section 4 consisting of a light-emitting diode display unit or a liquid crystal display unit for digitally displaying a 3-digit numeral, and a sounding section 5. In the casing 1 are accommodated circuit parts such as LSIs (large scale integrated circuit) constituting an electronic circuit, a loudspeaker, etc. as shown in FIGS. 3 and 4. The switch section 3 includes a mode switch section 3A as shown in FIG. 2. As is shown, the section 3A includes a tuning switch 3A-1, a tone set switch 3A-2, a split switch 3A-3, a rotary switch 3A-4 and a lower/volume switch 3A-5. When the tuning switch 3A-1 is turned on, a tuning mode is set, in which tuning can be made by operating the rotary switch 3A-4. When the tuning switch 3A-1 is "off", an arpeggio tempo can be set by operating the rotary switch 3A-4. When the tone set switch 3A-2 is turned on, a tone set mode is set, in which a tone color can be set by operating tone color switches in a tone color switch section 3B (FIG. 1).

When the split switch 3A-3 is turned on, a split mode is set, in which the keyboard 2 is split into a lower 2-octave part and an upper 3-octave part, these two parts providing different color tones in performance. Display members 3A-6 to 3A-8 each consisting of a LED (light-emitting diode) are provided for the respective switches 3A-1 to 3A-3. These display members are turned on when the corresponding switches are turned on. The switch section 3 further includes a power switch and various other switches, which are not described since they are irrelevant to the subject matter of the invention.

The main circuitry of this embodiment will now be described with reference to FIGS. 3 and 4. Referring now to FIG. 3, the outputs of the keyboard 2 and switch section 3 are supplied to a CPU (central processing unit) 11. The CPU 11 consists of, for instance a one-chip microprocessor, and it is connected with a tuning control section 12 through a data bus B1 and an address bus B2. It is also connected to two LSI chips 13A and 13B through a bus line B3. It is further connected to a driver 14 through a bus line B4. The CPU 11 calculates frequency data corresponding to the note of each operated key on the keyboard 2, and also control data corresponding to the outputs of various switches in the switch section 3, through processings which will be described later in detail. These data are supplied through the LSI chips 13A and 13B through the bus line B3. Further, display control data is supplied to the driver 14 through the bus line B4. The individual circuits such as the CPU 11 and LSI chips 13A and 13B as shown in FIG. 3 operate under the control of a basic clock (frequency $f_c$) provided from a reference oscillator 15 using a crystal oscillator.

The LSI chips 13A and 13B both operate on a time division basis for four channels so that each can simultaneously generate four different tones. The LSI chips 13A and 13B may be such as disclosed in an earlier U.S. application Ser. No. 324,466, filed on Nov. 24, 1981 (Japanese patent application No. 56-130875, entitled "Electronic Musical Instrument) and now U.S. Pat. No. 4,453,440, so their detailed construction is not described here. With the LSI chips 13A and 13B, the electronic musical instrument can simultaneously produce at most eight tones. Tone signals produced from the LSI chips 13A and 13B, which are digital signals, are fed to respective D/A (digital-to-analog) converters 16A and 16B. The outputs of the D/A converters 16A and 16B are sampled and held by respective S/H (sample/hold) circuits 17A and 17B. The outputs of the S/H circuits 17A and 17B are fed to respective filters 18A and 18B for removal of harmonic components corresponding to external switch operation. The outputs of the filters 18A and 18B are mixed and amplified in a mixer/amplifier 19, the output of which is fed to the sounding section 5 to be reproduced as audible sound. The LSI chips 13A and 13B are selected according to chip select signals CS1 and CS2 provided from the CPU 11. In the split mode which is set by operating the split key 3A-3, for example, the melody part of the music is produced by the LSI chip 13A while the accompaniment is simultaneously produced by the LSI chip 13B.

The driver 14 is a well-known circuit, which causes digital display of the frequency data of note A4 (i.e., a frequency in the neighborhood of 440 Hz) as a 3-digit numeral on the LED display section 4 according to display control data.

Designated at 12 is a tuning control section, which includes a count control section 12-1, a tuning counter 12-2, a ROM (read only memory) 12-3 and a RAM (random access memory) 12-4. The tuning counter 12-2 executes either up-counting or down-counting operation depending upon whether the count control section 12-1 provides a signal UP or DOWN. The ROM 12-3 is one in which are stored basic frequency data for the lowest octave (i.e., notes C1 to B1 in the first octave) as shown by hexadecimal data in FIG. 6 (numerals in parentheses in the Figure representing corresponding decimal figures). The RAM 12-4 stores modified frequency data which is obtained as a result of multiplication (i.e., processing) of the count data from the tuning counter 12-2 and the basic frequency data from the ROM 12-3. The tuning control section 12 further includes the tuning switch 3A-1. The ROM 12-3 and RAM 12-4 are addressed by address data provided from the CPU 11 through the address bus B2, and their output data are provided to the CPU 11 through the data bus B1. The RAM 12-4 is controlled for its data reading and writing operations by a read/write signal R/W provided from the CPU 11. The tuning counter 12-2 is a 10-bit counter. The most significant bit of its data is a sign bit, and the data is changed from "0111111111" (corresponding to a decimal number +511) to "01 . . . 10", . . . , "00 . . . 0", "11 . . . 1" up to "1000000000" (corresponding to a decimal number −512) with the operation of the rotary switch 3A-4. The data can also be changed in the opposite direction, i.e., from "10 . . . 0" to "01 . . . 1" with the rotary switch 3A-4. When the rotary switch 3A-4 is set to a center point, the tuning counter data is 10-bit all "0" (corresponding to a decimal number 0). The manner in which the tuning counter data changes will be described later in detail with reference to FIGS. 10 and 11.

The count control section 12-1 will now be described in detail with reference to FIG. 4. As is shown in the Figure, the rotary switch 3A-4 includes first and second movable contacts 3A-41 and 3A-42. The first movable contact 3A-41 has six integral blades 3A-41A to 3A-41F uniformly spaced apart (by an angle of 60 degrees) and is rotatable about a shaft 3A-43. The second movable contact 3A-42 meshes with and is electrically insulated from the outer periphery of the first movable contact 3A-41. By turning a knob of the rotary switch 3A-4 in the clockwise or counterclockwise direction, the first and second movable contacts 3A-41 and 3A-42 are turned in unison with each other in the same direction. The first movable contact 3A-41 is held at ground potential (i.e., "0" level), while the second movable contact 3A-42 is held at a potential of +V volts (i.e., "1" level). The shaft 3A-43 is provided at its two, diametrically spaced-apart points P1 and P2 with respective fixed contacts F1 and F2 which are in contact with the respective first and second movable contacts 3A-41 and 3A-42 for taking out a 2-bit signal.

Assume now that the rotary switch 3A-4 is turned in the clockwise direction from its position $\theta 0$ in FIG. 4, at which both the fixed contacts F1 and F2 are in contact with the second movable contact 3A-42 so that these fixed contacts F1 and F2 are providing respective "1" level signals, i.e., a 2-bit signal "11", to successive positions $\theta 1$, $\theta 2$, $\theta 3$, $\theta 4$, . . . . In this case, the 2-bit signal noted above is changed from "11" through "01", "00" and "10" to "11" again to repeat the same sequence of changes as shown in FIG. 5. As the rotary switch 3A-4 is turned from the position 0 to the position 3, i.e., for 60 degrees, the 2-bit signal successively assumes four different output states. Thus, while it is turned one rotation (i.e., 360 degrees), the four output states are repeatedly assumed six times. When the rotary switch 3A-4 is turned in the counterclockwise direction, the order of appearance of the successive output states of the 2-bit signal is reversed, and the four output states are repeatedly assumed six times in the reverse order.

The 2-bit signal from the rotary switch 3A-4 is fed to a control circuit 12-1A of the count control section 12-1. The control circuit 12-1A provides a reset signal, a "+1" signal or a "−1" signal to a 3-bit auxiliary counter 12-1B to control the counting operation of the auxiliary counter 12-1B depending upon the state of input of the 2-bit signal. The control circuit 12-1A also provides the signal UP or DOWN noted before to the tuning counter 12-2 for controlling the counting operation thereof in accordance with the count of the auxiliary counter 12-1B and the state of input of the 2-bit signal.

Figure 8:
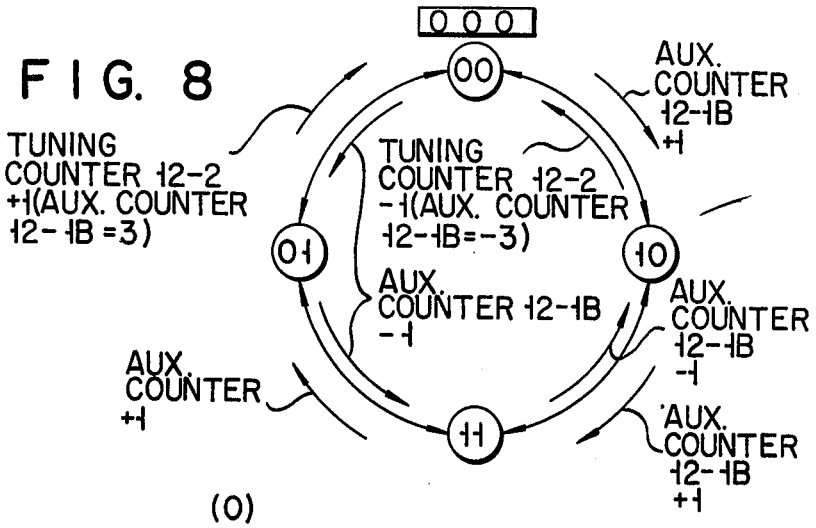
FIGS. 8, 9A and 9B are views for explaining the operation of a rotary switch.
Figure 9A:
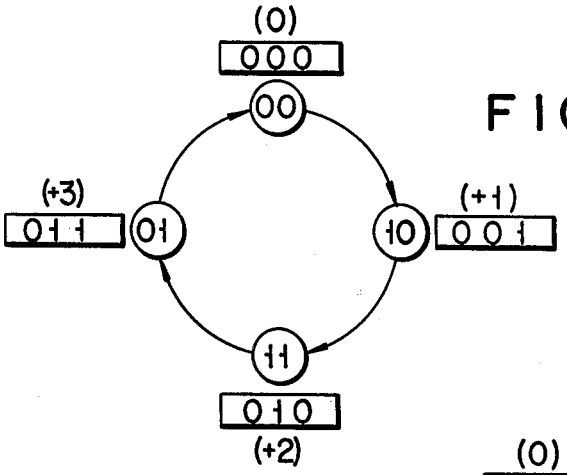
Figure 9B:
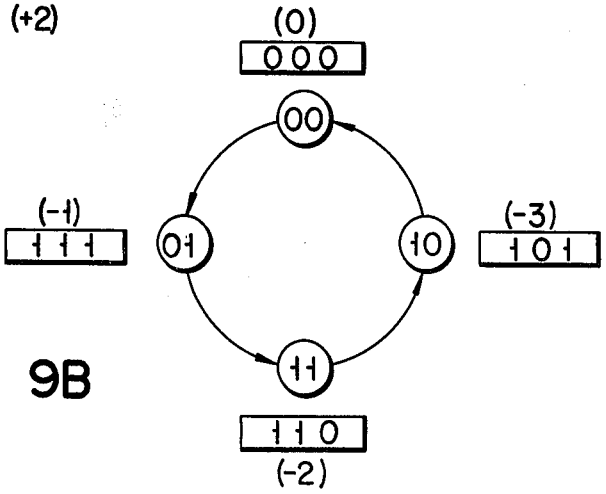

The function of the control circuit 12-1A will now be described in further detail with reference to FIGS. 8, 9A and 9B. These Figures show changes of the 2-bit signal and the count of the auxiliary counter 12-1B with the rotation of the rotary switch 3A-4 for 60 degrees in the clockwise or counterclockwise direction. First, referring to FIGS. 8 and 9A, when the rotary switch 3A-4 is turned in the clockwise direction while the 2-bit signal is "00", the 2-bit signal is first changed to "10", as shown in FIG. 5. At the time of this change, the control circuit 12-1A provides a "+1" signal. The count of the auxiliary counter 12-1B is thus incremented by "+1", that is, it is changed from "000" to "001". In the count of the auxiliary counter 12-1B (which is a 3-bit data), the most significant bit is a sign bit.

When the 2-bit signal is subsequently changed from "10" to "11", the control circuit 12-1A produces a "+1" signal again to increment the count of the auxiliary counter 12-1B to "010". With a subsequent change of the 2-bit signal from "11" to "01" the control circuit 12-1A further produces a "+1" signal again, incrementing the count to "011". When the 2-bit signal is restored from "01" to "00", the control circuit 12-1A produces a reset signal to reset the auxiliary counter 12-1B (i.e., the count thereof is rendered "000"). At the same time, it provides a signal UP to the tuning counter 12-2 to increment the count thereof by "+1". In the above way, as the knob of the rotary switch 3A-4 is turned in the clockwise direction so that the 2-bit signal is changed from "00" through "10", "11", "01", "00", . . . , the control circuit 12-1A provides a "+1" signal to the auxiliary counter 12-1B for each change of the 2-bit signal, whereby the count of the auxiliary counter 12-1B is progressively changed from "000" to "011". When the 2-bit signal is subsequently restored from "01" to "00", that is, when the rotary switch 3A-4 is rotated by 60 degrees while the count of the auxiliary counter 12-1B is "011" (i.e., +3), the control circuit 12-1A provides a reset signal to the auxiliary counter 12-1B while also providing a signal UP to the tuning counter 12-2.

When the direction of rotation of the rotary switch 3A-4 after being turned in the clockwise direction is reversed to the counterclockwise direction manually, or equivalent things happen due to chattering, the control circuit 12-1A operates as follows. When the 2-bit signal is reversely changed to the immediately preceding value, i.e., from "10" to "00", from "11" to "10" or from "01" to "11", the control circuit 12-1A provides a "−1" signal to decrement the count of the auxiliary counter 12-1B by "1". Particularly, when the 2-bit signal is changed to "01" from "00" so that the count is reversely changed after its change to "000", the control circuit 12-1A produces a "−1" signal to change the count to "111", i.e., change it by "−1". Further, when there occurs a situation which does not usually take place such as a change of the 2-bit signal from "00" to "11" from "11" to "00" or a change from "10" to "01" or from "01" to "10", the control circuit 12-1A produces a reset signal to forcively render the count of the auxiliary counter 12-1B to be "000". It is to be understood that if the rotary switch 3A-4 is reversed while it is being turned or if chattering occurs, the control circuit 12-1A reliably brings about the immediately preceding state or the reset state. Thus, reliable counting operation of the tuning counter can be obtained. This is particularly effective, since the chattering of the rotary switch can be reliably prevented.

The operation of the control circuit 12-1A that takes place when the rotary switch 3A-4 is turned in the counterclockwise direction with the 2-bit signal being initially "00" will now be described with reference to FIGS. 8 and 9B. In this case, the 2-bit signal is changed conversely to the case shown in FIG. 5, that is, it is changed from "00", through "01", "11", "10", "00", . . . . When the 2-bit signal is changed from "00" to "01", the control circuit 12-1A produces a "−1" signal to the auxiliary counter 12-1B. The count is thus changed from "000" by "−1" to "111". When the 2-bit signal is further changed from "01" to "11" and then to "10", a "−1" signal is provided at each change. The count is thus successively incremented by "−1"s to "110" and "101". When the 2-bit signal is changed from "10" to "00" with the count being "101", the control circuit 12-1A provides a reset signal to the auxiliary counter 12-1B to render the count to be "000". At the same time, it provides a signal DOWN to the tuning counter 12-2 to change the count thereof by "−1". In the above way, when the rotary switch 3A-4 is turned in the counterclockwise direction, the control circuit 12-1A provides "−1" signals normally, causing the count of the auxiliary counter 12-1B to be changed by "−1"s, while with a count of "101" (i.e., +3) it provides a reset signal and a signal DOWN.

When the direction of rotation of the rotary switch 3A-4 after being turned in the counterclockwise direction is reversed to the clockwise direction manually or equivalent things happen due to chattering, the control circuit 12-1A functions similarly to the previous case of reversal of the clockwise direction. More particularly, when the 2-bit signal is reversely changed to the immediately preceding value, i.e., from "10" to "00", from "11" to "10" or from "01" to "11", the control circuit 12-1A provides a "−1" signal to decrement the count of the auxiliary counter 12-1B by "1". When the 2-bit signal is restored to "10" after reaching "00", the auxiliary counter 12-1B provides a "+1" signal to change the count to "001" (i.e., +1). Further, when there occurs a situation which does not usually take place such as a change of a 2-bit signal from "00" to "11" or from "11" to "00" or from "01" to "10" of from "10" to "01", the control circuit 12-1A produces a reset signal to render the count of the auxiliary counter 12-1B to be "000".

As has been shown, in case of turning the rotary switch 3A-4 in the clockwise direction, the count of the tuning counter 12-2 is incremented by "+1" only when the switch is rotated by 60 degrees. On the other hand, in the case of turning the switch in the counterclockwise direction, the count of the tuning counter 12-2 is incremented by "−1" when the switch is rotated by 60 degrees. The auxiliary counter 12-1B and control circuit 12-1A thus completely eliminate malfunction due to chattering.

In the ROM 12-3, the basic frequency data for one octave as shown in FIG. 6 is stored as mentioned earlier. Since the electronic musical instrument operates in synchronism with the reference clock provided from the reference clock generator 15, the basic frequency data stored in the ROM 12-3 is such that the frequency corresponding to note A4 is 442 Hz.

The operation of the above embodiment will be described with reference to the flow chart of FIG. 7. When the tuning switch 3A-1 is turned on after turning on the power switch of the electronic musical instrument, the output of the switch is supplied to the CPU 11. Thus, a tuning mode is set, in which tuning can be made by operating the rotary switch 3A-4. At the same time, the display member 3A-6 is turned on.

If the rotary switch 3A-4 has been set to its center point, the count of the tuning counter 12-2 is 10-bit all "0". Then, a step S1 in the flow chart of FIG. 7 is executed, in which the CPU 11 reads out the count of the tuning counter 12-2. In a subsequent step S2, the CPU 11 calculates tuning data from the count noted above, i.e., 10-bit all "0" data, and multiplies the tuning data thus obtained by 442, thus obtaining the frequency corresponding to note A4. The tuning data TU is calculated using an equation $$TU=(1024+CNT)/1024 \quad (1)$$

where CNT is the count of the tuning counter 12-2 and is $-512<CNT<+511$.

The frequency FD corresponding to A4 to be displayed is thus $$FD=TU\times 442 \quad (2)$$

Since the count CNT is 0 in this case, the tuning data TU is 1 from the equation (1), and the frequency FD to be displayed is 442 Hz from the equation (2). The CPU 11 supplies display control data for displaying the frequency of 442 Hz to the driver 14 through the bus line B4 so that "442" is displayed on the display section 4. This is done in a step S3.

In a subsequent step S4, the CPU 11 provides address data for addressing the ROM 12-3 through the address bus B2 to the ROM 12-3. According to these address data, the basic frequency data, i.e., data "157", "16C", . . . , "289" for C, C#, . . . , B, are successively read out from the ROM 12-3 and transferred through the data bus B1 to the CPU 11. The CPU 11 calculates modified frequencies $f_c$ from the individual read-out data according to an equation $$F_c=TU\times F_c \quad (3)$$

where $F_c$ represents the basic frequency data.

Since TU=1 in this case, the same data as the basic frequency data $F_c$ is written as the modified frequency data $f_c$ in the RAM 12-4. In the step S4, the CPU 11 provides successive read/write signals R/W to the RAM 12-4 to control the writing of the modified frequency data $f_c$ corresponding to the individual notes.

The rotary switch 3A-1 then executes steps S5 and S6, in which it checks whether the count of the tuning counter 12-2 is changed and whether the tuning mode prevails, until tuning is actually done by operating the rotary switch 3A-4.

The operation will now be described in connection with the case when the rotary switch 3A-4 is turned in the clockwise direction, i.e., toward higher frequencies, until the count of the tuning counter 12-2 is changed to "0100000000" (corresponding to +256). Initially, the rotary switch 3A-4 is at its center position, and the 2-bit signal which is taken out from its fixed contacts F1 and F2 and supplied to the control circuit 12-1A is "00" as shown in FIG. 5. While the rotary switch is turned from its center position in the clockwise direction for 60 degrees, the 2-bit signal is changed from "00" through "10", "11" and "01" to "00" again as is seen from FIGS. 8 and 9A. Every time the 2-bit signal is cyclically changed, the control circuit 12-1A provides three "+1" signals to the auxiliary counter 12-1B, and then it provides a reset signal. During this time, the count of the auxiliary counter 12-1B is changed from "000" through "001", "010" and "011" to "000". When the count of the auxiliary counter 12-1B is reset to "000", the control circuit 12-1A provides a signal UP to the tuning counter 12-2. At this time, the count of the tuning counter 12-2 is incremented by +1 to "0000000001" (corresponding to +1).

While the rotary switch is rotated by further 60 degrees in the clockwise direction, the same sequence of events as described above takes place, and with the restoration of the 2-bit signal to "00" the count of the tuning counter 12-2 is further incremented by +1 so that it becomes "0000000010" (corresponding to +2).

When the rotary switch 3A-4 is further rotated by 240 degrees (i.e., four times 60 degrees), that is, when it is turned one rotation from the center position, the operation described above is repeatedly executed four times. During this time, the count of the tuning counter 12-2 is incremented by +4 to "0000000110" (corresponding to +6).

That is, while the rotary switch 3A-4 is turned one rotation in the clockwise direction, the count of the tuning counter 12-2 is incremented by +6. Thus, by further turning the rotary switch 41 and 4/6 rotations in the clockwise direction, the count of the tuning counter is changed to the desired value corresponding to +256.

Figure 7:
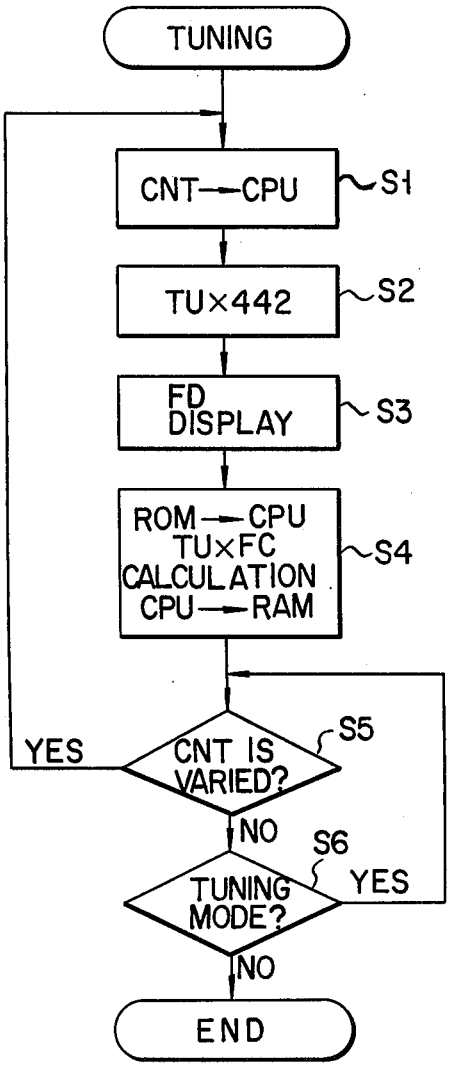
FIG. 7 is a flow chart for explaining tuning operation.

During the above operation, the CPU 11 repeatedly executes the steps S1 through S5 in FIG. 7 with the progressive increase of the count of the tuning counter 12-2. Also, since the tuning data TU given by the equation (1) is progressively increased, the frequency FD corresponding to the note displayed on the display section 4, as given by the equation (2), is progressively increased from 442 by 1s. When +256 is reached by the count of the tuning counter 12-2, the value of the frequency FD is 552.5, so that "552" is displayed on the display section 4. By stopping the rotary switch 3A-4 as soon as this display on the display section 4 is confirmed, the count of the tuning counter 12-2 is set to a value in the neighborhood of +256.

Also, during the above operation, the data in the RAM 12-4 is progressively altered through the processing of the step S4 based on the equation (3) with increasing tuning data TU.

Further, when the direction of rotation of the rotary switch 3A-4 being turned in the clockwise direction is reversed by mistake to the counterclockwise direction, or equivalent things happen, i.e., failure of appearance of the output from the fixed contacts F1 and F2 in the proper order, due to chattering, the control circuit 12-1A of the count control section 12-1 executes the anti-chattering operation as described earlier, that is, it provides a "−1" signal and/or a reset signal, so that reliable tuning can be obtained.

If the count of the tuning counter 12-2 is accurately set to +256, value "552" is displayed on the display section 4 through the last processing of the steps S1 to S3 in the flow chart of FIG. 7 when the rotary switch 3A-4 is stopped. Further, in the last processing of the step S4 the tuning data TU is calculated to be 1.25 from the equation (1), so that 1.25 times the basic frequency data shown in FIG. 6 are written as the modified frequency data in the RAM 12-4. FIG. 12 shows the modified frequency data written in the RAM 12-4 at this time as hexadecimal data (numerals in parentheses representing corresponding decimal figures).

When the tuning is completed, the tuning switch 3A-1 is turned off. As a result, the CPU 11 is brought from the tuning mode into a standby state ready for tone generation processing. At this time, the display member 3A-6 is turned off. In this state, by operating a key on the keyboard 2 for performance of music, the CPU 11 discriminates the octave and note of the operated key and calculates a corresponding key code. If the note is C, for instance, the RAM 12-4 is addressed such that data "1AC" in FIG. 12 is read out as the modified frequency data $f_c$. A 3-bit octave code OC then is added to the upper bit side of the data "1AC", and the resultant 13-bit frequency data as shown in FIG. 13 is supplied to the bus line B3. The CPU 11 also provides control data corresponding to the states of various switches in the switch section 3 to the bus line B3. Thus, the tone of the operated key is generated in the LSI chip 13A or 13B selected by the chip select signal CS1 or CS2, and then sounded from the loudspeaker 20.

Figure 10:
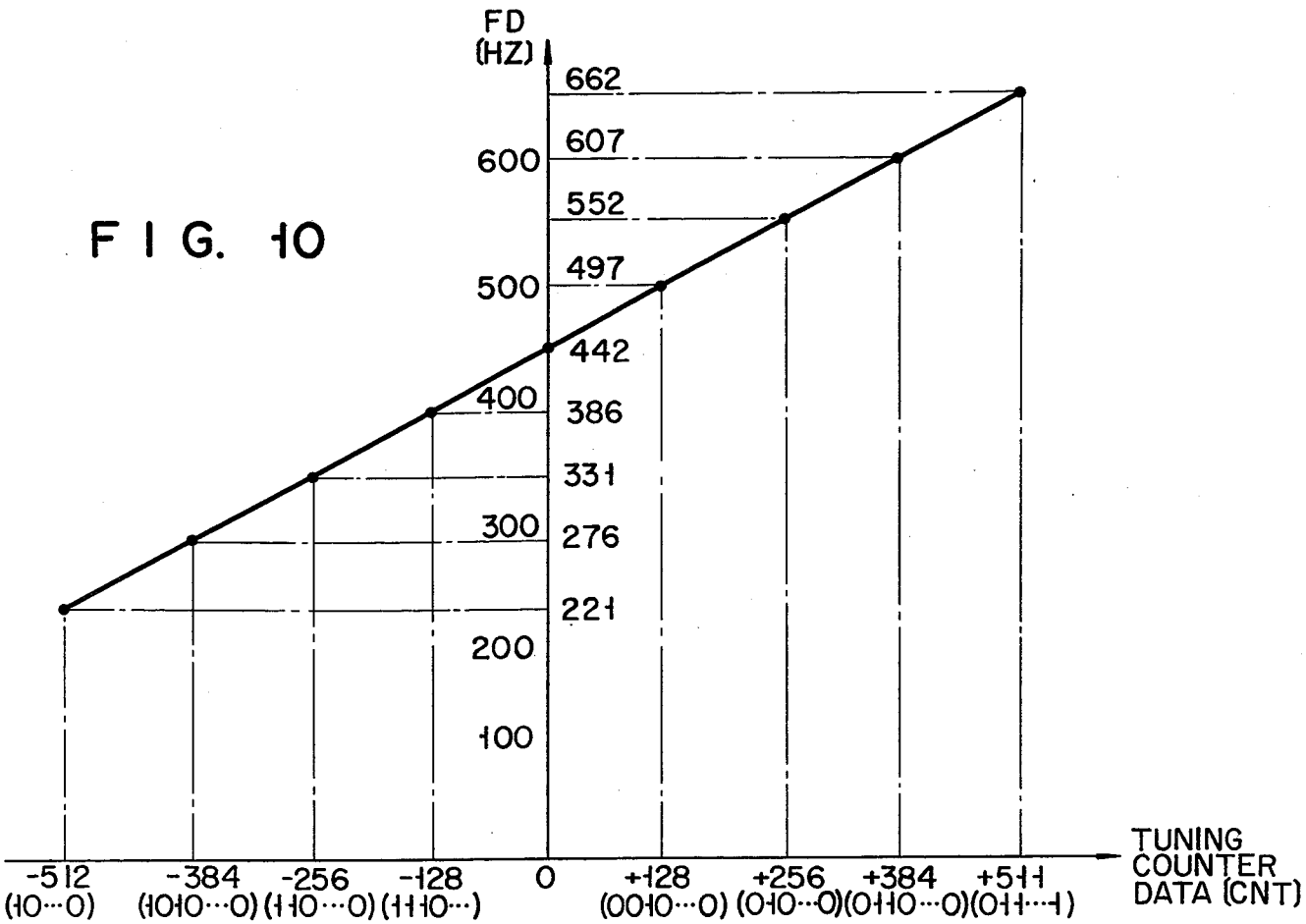
FIGS. 10 and 11 are graphs showing the relation between the frequency corresponding to note A4 and tuning counter data.

FIG. 10 shows the relation between the count CNT of the tuning counter 12-2 that is changed by the tuning operation and the frequency FD corresponding to note A4 in the instant embodiment. In the instant embodiment, as is seen from FIG. 10, by turning the rotary switch 3A-4 in the clockwise direction for tuning, the reference value 442 Hz of the frequency FD corresponding to note A4 can be changed up to a maximum value of 662 Hz, a frequency which is higher than the reference frequency by approximately one half octave. At this time, the count CNT of the tuning counter 12-2 is "0111111111" (corresponding to +511). By turning the rotary switch 3A-4 in the counterclockwise direction, the reference value of 442 Hz can be changed down to a miminum value of 221 Hz, a frequency lower than the reference frequency by one octave. The count CNT at this time is "1000000000" (corresponding to −512). As has been shown, with the present embodiment, tuning toward higher and lower frequencies over a total range corresponding to approximately 1.5 octaves can be readily done by merely turning the rotary switch 3A-4. Further, a wide frequency range is covered for tuning by operating the rotary switch 3A-4, which is desired very much for performance effects.

Figure 11:
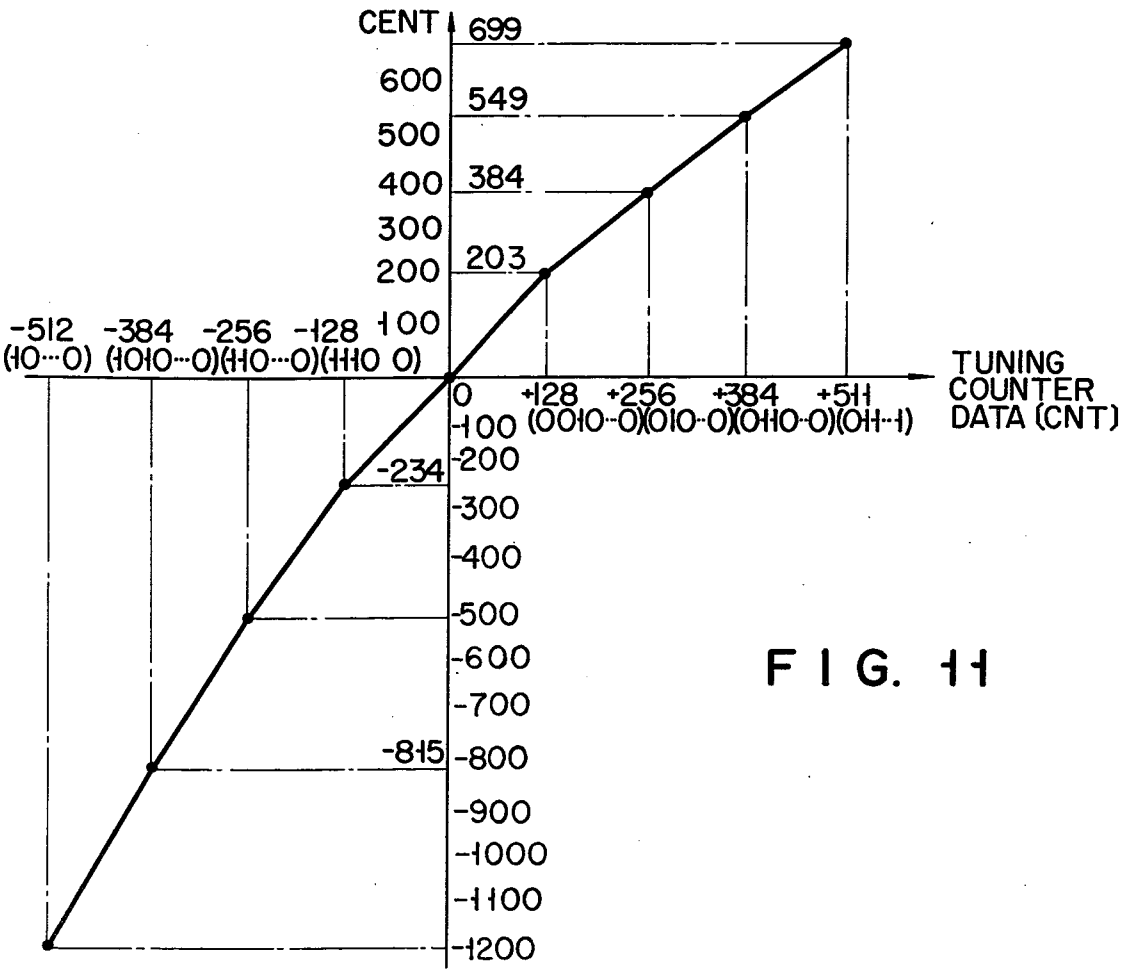

FIG. 11 shows a graph which is similar to the graph of FIG. 10 but the ordinate is graduated not by Hz but by cent. It will be seen that with the reference value set to 0 cent, it is possible to obtain tuning to a maximum of 699 cent and a minimum of 1,200 cent. The frequency y (Hz) in the case of FIG. 10 can be converted to x (cent) in the case of FIG. 11 using an equation $$y(\text{Hz}) = 442 \times 2^{\frac{x(\text{cent})}{1200}} \quad (4)$$

In the above description of operation of the embodiment, the case of tuning to frequencies lower than the reference value of 442 Hz by turning the rotary switch 3A-4 in the counterclockwise direction was not taken. However, it will be understood that the same operation is brought about under the control of the control circuit 12-1A except for that the count of the tuning counter 12-2 is decremented by 1s.

FIG. 14 shows a second embodiment of the invention. In this embodiment, an up/down switch 3A-9 is used in lieu of the rotary switch 3A-4 in the preceding embodiment. The output of the up/down switch 3A-9 is supplied to the tuning counter 12-2 for controlling the up- or down-counting operation thereof. When an UP switch 3A-9UP of the up/down switch 3A-9 is "on", the tuning counter 12-2 up-counts a predetermined clock. On the other hand, when a DOWN switch 3A-9DN is "on", the tuning counter 12-2 down-counts the clock. The count of the tuning counter 12-2 is supplied to the CPU 11 for processing as in the preceding first embodiment. As an alternative, a "+1" or "−1" may be counted every time the UP or DOWN switch 3A-9UP or 3A-9DN is turned on.

As has been shown, by using the up/down switch the tuning operation can be further simplified.

While in the first embodiment the count of the tuning counter is incremented by "+1" or "−1" every time the rotary switch is turned 60 degrees, this angle may of course be suitably changed. Also, the tuning frequency range can be suitably changed, and the crystal oscillator used as the main oscillator may be replaced with different types of oscillators such as an LC oscillator or an RC oscillator. Further, while the above embodiments are concerned with a polyphonic electronic musical instrument capable of producing at most eight different tones at a time, this is by no means limitative.

Figure 15:
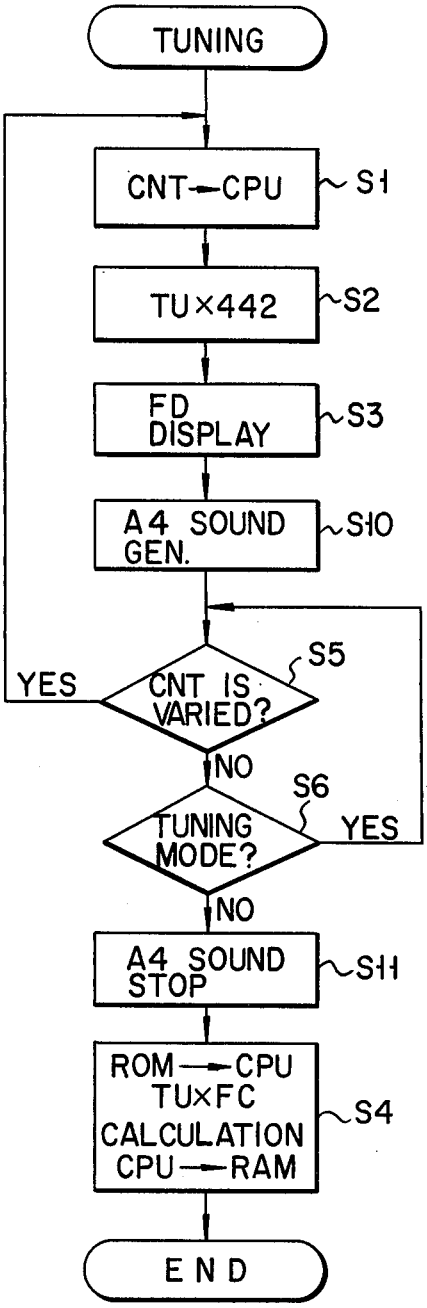
FIG. 15 is a flow chart for explaining a modification of the tuning operation shown in FIG. 7.

FIG. 15 shows a modification of the operation of the flow chart of FIG. 7. Here, the same steps as those in FIG. 7 are designated by like reference symbols, and will not be described any further. In this case, a step S10 is executed subsequent to the step S3. In the step S10, the tone of note A4, for which the modified frequency is obtained in the step S2, is generated in the LSI chip 13A (or 13B) and is sounded from the loudspeaker 20. Thus, in the step S10 tones corresponding to successively changing tuning data TU can be heard.

Subsequent to the step S10 the step S5 is executed, and then a step S11 is executed. In the step S11, the tuning mode set up by the tuning switch 3A-1 is discontinued to mute the tone of note A4. When the tuning switch 3A-1 is turned off, the CPU 11 commands the LSI chip 13A (or 13B) to stop sounding of the prevailing tone being sounded.

Subsequent to the step S11 the step S4 is executed. Since the processing of the step S4 is executed on the finally determined tuning data TU, the tuning control can be obtained without increasing the processing speed of the CPU 11 compared to the case of the flow chart of FIG. 7.

As has been described in the foregoing, with the tuning control apparatus according to the invention, basic frequency data stored in a ROM, and tuning data obtained by externally operating a rotary switch or like tuning means, is processed with the basic frequency data read out from the ROM to obtain modified frequency data which is stored in a read/write memory for obtaining tones according to the data stored in the read/write memory. Thus, it is possible to obtain steady and accurate tuning at all times irrespective of the kind of main oscillator being used. Further, since the modified frequency obtained by the tuning is digitally displayed with respect to the frequency corresponding to a particular note, for instance note A4, the content of tuning can be readily confirmed and can be readily reproduced. Moreover, since the tuning data is made by operating a rotary switch or an up/down switch, satisfactory operation control characteristics can be obtained.

Further, by permitting the tone of the note corresponding to the modified frequency to be sounded at the time of the tuning operation, the result of tuning can be confirmed by the user's sense of hearing.

What is claimed is:

1. In a tuning control apparatus comprising read only memory means for storing basic frequency data corresponding to each of a set of notes spanning at least one octave;

a tuning device including tuning data producing means for providing tuning data according to an external operation, and processing means for processing the basic frequency data read out from said read only memory means and tuning data provided by said tuning data producing means to obtain modified frequency data corresponding to said set of notes spanning at least one octave; and tone generating means for generating a tone signal with a frequency corresponding to either of said basic frequency data and said modified frequency data;

in combination the improvement wherein said tuning device comprises read/write memory means coupled to said processing means for storing the modified frequency data corresponding to said set of notes spanning at least one octave as obtained from said processing means, wherein said processing means is arranged to selectively transfer the modified frequency data stored in said read/write memory means to the tone generating means for generating a tone signal of corresponding frequency.

2. The tuning control apparatus according to claim 1, wherein said tuning data producing means includes a rotary switch, said tuning data being produced according to external operation of said rotary switch.

3. The tuning control apparatus according to claim 1, wherein said tuning data producing means includes an up/down switch, said tuning data being produced according to external operation of said up/down switch.

4. The tuning control apparatus according to claim 1, which further comprises display means for selectively displaying one of said basic frequency data and said modified frequency data.

5. The tuning control apparatus according to claim 4, wherein the selected one of said basic frequency data and said modified frequency data displayed on said display means corresponds to note A4.

6. The tuning control apparatus according to claim 1, which further comprises sounding means for automatically sounding the tone of a note based on said modified frequency data obtained according to the external operation.

7. The tuning control apparatus according to claim 6, wherein said tone automatically sounded from said sounding means corresponds to note A4.

8. The tuning control apparatus according to claim 2, wherein said rotary switch of said tuning data producing means includes a shaft, a first movable contact having a plurality of uniformly spaced-apart blades and rotatable about said shaft, said first movable contact being held at a first potential level, a second movable contact insulated from said first movable contact and secured to and rotatable in unison with said first movable contact about said shaft, said second movable contact being held at a second potential level, and first and second fixed contacts in contact with said respective first and second movable contacts.

9. The tuning control apparatus according to claim 8, wherein said tuning data producing means further includes a control circuit for receiving a 2-bit signal produced from said first and second fixed contacts and producing a "+1" signal, a "−1" signal and a reset signal, an auxiliary counter supplied with said "+1" signal, "−1" signal and reset signal from said control circuit, and a tuning counter controlled by an UP/DOWN signal obtained from said control circuit according to the data in said auxiliary counter.

10. The tuning control apparatus according to claim 2, which further comprises display means for selectively displaying one of said basic frequency data or modified frequency data.

11. The tuning control apparatus according to claim 3, which further comprises display means for selectively displaying one of said basic frequency data and said modified frequency data.

12. A tuning control apparatus comprising:

a read only memory in which basic frequency data is stored;

tuning data producing means for providing tuning data according to external operation, wherein said tuning data producing means includes a rotary switch, said tuning data being produced according to an external operation of said rotary switch, said rotary switch including a shaft, a first movable contact comprising a plurality of uniformly spaced-apart blades and rotatable about said shaft, said first movable contact being held at a first potential level, a second movable contact insulated from said first movable contact and secured to and rotatable in unison with said first movable contact about said shaft, said second movable contact being held at a second potential level, and first and second fixed contacts in contact with said first and said second movable contacts, respectively, wherein said tuning data producing means further includes a control circuit for receiving a 2-bit signal produced from said first and second fixed contacts and producing a "+1" signal, a "−1" signal and a reset signal, an auxiliary counter supplied with said "+1" signal, "−1" signal and reset signal from said control circuit, and a tuning counter controlled by an UP/DOWN signal obtained from said control circuit according to the data in said auxiliary counter;

processing means for processing basic frequency data read out from said read only memory and tuning data provided from said tuning data producing means to obtain modified frequency data; and a read/write memory for storing the modified frequency data obtained from said processing means;

said modified frequency data stored in said read/write memory being selectively transferred to tone generating means for generating a tone signal of a corresponding frequency.

* * * * *